United States Patent [19]

Alikhan

[11] 4,279,363

[45] Jul. 21, 1981

[54] NON-INVERTING FLUID DISPENSER

[76] Inventor: Raza Alikhan, 201 Willowridge Ct., Oakville, Ontario, Canada, L6L 5J1

[21] Appl. No.: 65,574

[22] Filed: Aug. 10, 1979

Related U.S. Application Data

[63] Continuation-in-part of Ser. No. 962, Jan. 5, 1979, abandoned.

[51] Int. Cl.[3] ..... B65D 35/22

[52] U.S. Cl. ..... 222/94; 222/212

[58] Field of Search ..... 222/95, 96, 94, 386.5, 222/188, 212, 211, 181, 209, 214, 481.5

[56] References Cited

U.S. PATENT DOCUMENTS

| | | | |
|---|---|---|---|
| 3,656,660 | 4/1972 | Mueller | 222/212 X |
| 3,945,366 | 3/1976 | Matthews | 222/481.5 X |
| 4,099,655 | 7/1978 | Por | 222/211 |
| 4,159,790 | 7/1979 | Bailey | 222/211 |

*Primary Examiner*—Stanley H. Tollberg

*Attorney, Agent, or Firm*—Donald E. Hewson

[57] ABSTRACT

A fluid dispenser particularly for use at the bottom of a deformable or partly flexible container is disclosed, which dispenser includes a base member having therein a vent providing an air passage controlled by a valve, and a fluid dispensing passage also controlled by a valve. The exterior air vent tube and exterior dispensing tube of the dispenser are usually sealed until the first use of the dispenser, at which time the container is substantially fixed in place with the dispenser at the bottom thereof, and the seals of the exterior air vent and dispensing tubes are broken. The dispensing action is carried out by pressing a deformable portion of the container thereby increasing the pressure within the container, and in the normal, inverted position of the container with the dispenser at the bottom thereof—i.e., the dispensing action is non-inverting. Alternatively, particularly where an air/fluid contact is to be precluded, a bladder may be placed within the container, having fluid communication with the air passage, for expansion and pressure equalization as the dispensing action continues. In yet another alternative, the bladder may be filled with fluid.

9 Claims, 10 Drawing Figures

NON-INVERTING FLUID DISPENSER

This application is a continuation-in-part of application Ser. No. 000,962, filed Jan. 5, 1979, now abandoned.

FIELD OF THE INVENTION

The present invention relates to improvements in or relating to flexible dispensing containers.

BACKGROUND OF THE INVENTION

Fluid or liquid dispensing containers are usually designed to dispense the contained material through a dispensing neck or outlet which may be provided with dispensing valve means, particular dispensing nozzles or the like devices facilitating the dispensing. Also, it is normally required that the container from which the material is dispensed be inverted in order to carry out the dispensing. A number of proposal have been described in prior art patents. For example R. J. MOLYNEAUX et al, U.S. Pat. No. 3,094,250 issued June 18, 1963 teaches a valve which provides for a very slow back-flow from the container cap interior into the container when the valve member is seated for the purpose of measuring and dispensing from the top. E. DAVIDSON, U.S. Pat. No. 3,162,333 issued Dec. 22, 1964, describes a pump assembly for liquid dispensers wherein the pump body is incorporated into the neck of a container-top dispenser. The dispenser is shaped for a snap fit of its base member into a base opening, and has a resilient leaf spring projecting upwardly therefrom. A one-way intake valve is positioned in the intake conduit and a one-way outlet valve is positioned in the outlet conduit. G. B. DAVIS, JR., U.S. Pat. No. 3,176,883 issued Apr. 6, 1965 relates to an atomizing dispenser with attendant passages for air and liquid flow from within the container to the discharge port thereof. D. F. CORSETTE, U.S. Pat. No. 3,439,843 issued Apr. 22, 1969 shows a dispensing valve top closure which is supported on the neck of a container for limited axial movement between a raised, dispensing, position and a lower, closed, position, where inter alia, the discharge passage opens radially into the closure from an annular space and extends through the top wall of the closure into communication with the atmosphere. L. L. POR, U.S. Pat. No. 3,837,542 issued Sept. 24, 1974 is concerned with a metering liquid dispenser having a metering compartment for the provision of a metered volume of the material to be dispensed. R. E. HAZARD, U.S. Pat. No. 3,874,562 issued Apr. 1, 1975, teaches a dispensing closure with pump parts and a dispensing spout on the dispensing closure which is movably mounted so as to be capable of being moved between an open position in which the spout is in communication with the opening and a closing position in which the spout seals off the dispensing opening. L. L. POR, U.S. Pat. No. 3,873,972 issued Apr. 22, 1975, is concerned with a liquid measuring and dispensing apparatus including a flexible container which is squeezably operated to open an outlet valve for discharging a quantity of fluid from its top, whereby the decrease of pressure within the container causes to open an air inlet valve so that air enters the container when the squeezing pressure is released. L. L. POR, U.S. Pat. No. 4,099,655, issued July 11, 1978, is concerned with an upper and a lower seat, the ball engaging one or the other seat depending on the attitude of the container. Thus, when the container is upright, the ball contacts the lower seat and on squeezing of the container liquid will be discharged through the fluid outlet while at the same time the air inlet valve will prevent discharge of air from the container. In the inverted position, the ball contacts the other seat and on squeezing of the container liquid is discharged through the air inlet valve.

There exists, however, the need for an effective fluid dispenser which is particularly adapted to dispense the material within the container with which the dispenser is associated in such a manner that the container need not be turned over or inverted for the dispensing function. That is, the container and the dispenser therewith are non-inverting, and the dispensing is normally from the bottom of the container, where the dispenser has separate air inlet and liquid outlet passages.

SUMMARY OF THE INVENTION

It is an object of the present invention to provide a container and a dispenser associated therewith which is particularly adapted to dispense fluid—particularly liquid—materiai from the bottom of the container, when the container is in its normal position with the dispenser at the bottom thereof.

A further object of the present invention is to provide a dispenser with a valve-controlled air vent tube which is integrally formed with the dispenser so as to achieve a prompt and easy dispensing action.

It is an important feature of this invention that the normal position (orientation) of the container is downward and inverted, and that it is ready for use in that position, having separate closed air inlet and liquid outlet passages when not operating in a dispensing action.

Yet another important feature of this invention is that, with the dispenser at the bottom of a container, upon initiation of the dispensing action, the liquid outlet valve immediately opens so as to permit liquid dispensing, and the air inlet valve will open immediately upon release of the pressure being created within the container by deforming the same.

In accordance with the present invention, there is provided a dispenser which comprises a plug-like base member having a valve-controlled liquid outlet in communication with the interior of the container, and a valve-controlled air vent tube adapted to be in communication with the atmosphere on use and with the interior of the container. In accordance with the present invention, the valve control means can be provided by check valve means, by a flap valve of either gravity or resiliently biased means, or other similar valve means. The dispenser and the container with which the dispenser is associated are particularly adapted for use in the dispensing of fluids such as, for example, liquid detergents, lotions, shampoos or the like, when the container is in its normal position with the dispenser at the bottom thereof. The container with the dispenser therein therefore does not need to be inverted, turned, twisted, lifted or opened prior to a dispensing action, and, can be readily secured to a stand, on a wall, on a counter top, or such like support. Dispensing material therefrom is readily, yet effectively, carried out by deforming the container or at least a portion thereof, and causing an increase of pressure therein. Since the fluid to be dispensed is always at or proximal to the discharge valve, there is no delay in the dispensing action. It is of particular advantage that the dispenser and the container with which it is used can be furnished as a completely sealed unit so that no inadvertent leakage and dispensing of material therein takes place, as might be the case with the relatively complex pump and movable spout arrangements disclosed in the prior art. It is also a particular advantage that the container may be formed at its upper end without any top, cap, closure or other opening, and that the material within the container may be charged into the container through the opening in which the dispenser is placed when the container is in an inverted position, thereby permitting new, versatile and aesthetic configurations of container not heretofore possible.

BRIEF DESCRIPTION OF THE DRAWINGS

These and other features and objects of the present invention are more fully described with reference to the accompanying drawings, in which.

DESCRIPTION OF THE PREFERRED EMBODIMENTS

Figure 1:
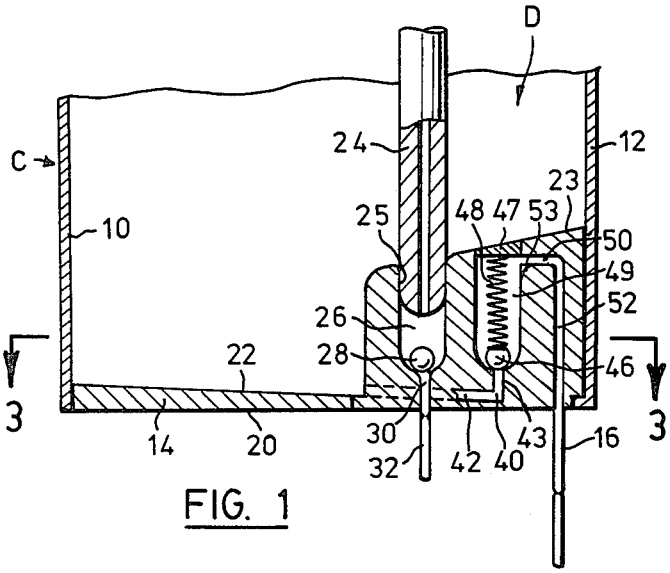
FIG. 1 is a side elevation view in cross-section of a first embodiment of a dispenser located in the bottom wall of a container.
Figure 2:
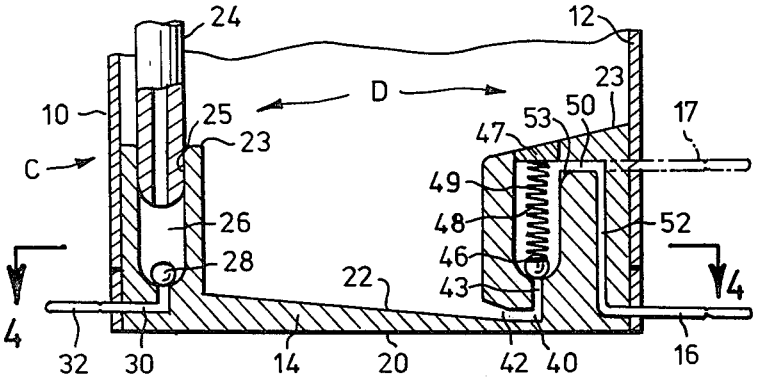
FIG. 2 is a side elevation view in cross-section of a second embodiment of a dispenser located in the bottom wall of a container.

Referring to each of FIGS. 1 and 2, a container C is shown in part having side walls 10 and 12 which are joined or connected to a bottom wall 14 and a top wall, not shown. The particular configuration of the container C is not important for the functioning of the present invention, but it is adapted to suit the dispensing features which may be required or desireable in keeping with the discussion of FIGS. 5 to 8 hereafter. In general, the container C should be of a suitable fluid impervious material, and preferably presents an interior surface which is essentially non-wetting. The configuration at the bottom wall 14 is such as to substantially completely collect the total quantity of the material within the container, thereby considerably reducing wastage.

Dispenser D is suitably positioned in the bottom wall 14 of container C, with the dispensing liquid outlet 16 preferably being close to one of the side walls 10 or 12 (see wall 12 in FIGS. 1 and 2), as may be most suited for dispensing. The dispenser may be somewhat rectangular in configuration. In any event, bottom wall 14 and dispenser D have a lower surface 20 and upper surfaces 22 and 23 which are sloped downwards so as to drain the last portions of fluid within the container C towards the liquid dispensing outlet 16 as discussed in greater detail hereafter. The upper surface 23 of the dispenser is formed in such a manner as to receive and retain the control valve means for the dispenser, discussed hereafter.

From the upper surface 23 of the dispenser D there emerges an interior tube vent 24 which extends in an upward direction for a distance as to be safely above the maximum level of the liquid content of the container when filled and oriented in its inverted, dispenser-down position. The interior vent tube 24 has the purpose of sending air into the interior of the container. The vent tube 24 can, of course, be formed with one of the walls of the container, and can be provided as a separate tube which may be inserted into a matching bore 25, as shown, and secured therein. As indicated in FIGS. 1 and 2, the vent tube 24 is in communication with a valve compartment 26 which is formed in the dispenser D. The valve compartment 26 is formed so as to provide at least one seat at the bottom end thereof for a valve member which is provided. In the embodiment shown, the valve is shown to be a ball 28, which is conveniently placed in its position within the valve compartment 26 prior to insertion or formation of the tube 24. It should be noted that the ball 28 is seated due to gravity, thereby closing the passage 30 which communicates the interior of the container, through valve compartment 26, with the atmosphere such as by way of an exterior vent tube 32. The lower or outer end of the vent tube 32 is preferably closed until it is intended that the container be used for dispensing the material therein. The vent tube 32 is preferably integrally formed with the dispenser D, although the vent tube 32 may also be provided by way of a separate tube which is inserted and secured within the passage 30. The closed end of the vent tube 32 may be easily opened by cutting or clipping off a short portion thereof; or alternatively, the closed end of the vent tube 32 may be provided with a weakened portion of the material thereof, so that the tip may be easily removed by snapping it off.

Figure 3:
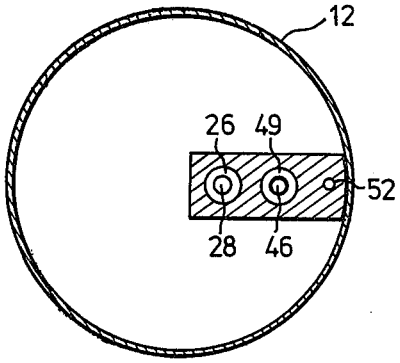
FIGS. 3 and 4 are plan views, in cross-section, looking in the direction of arrows 3—3 and 4—4 in FIGS. 1 and 2, respectively.

In addition to the vent means just described, the dispenser D includes a liquid dispensing valve assembly which controls the dispensing of the material contained within the container C. The liquid dispensing valve assembly is in communication with the interior of the container C by way of passages 42 and 43 formed in the bottom of the dispenser. As noted, the upper surface 22 of the bottom wall 14 is gradually sloped away from the side wall 10, in this case as illustrated, towards the passage 43, with the lowest point of the interior of the container C and the dispenser D being accessible to the fluid content of the container C at point 40 which is at the junction of passages 42 and 43. Thus, the passage 43 is in communication with the interior of the container by way of the sloped passage 42 which merges with a corresponding sloped upper surface 22 of the bottom wall 14. In the embodiments of FIGS. 1 and 3, the passage 30 extends through a portion of the space occupied by passage 42, but not in communication therewith, in such a manner that sufficient space within the passage 42 exists so as to permit fluid flow of material within the passage 42 past the tube walls of the passage 30.

The upper end of the passage 43 is provided with a seat for a valve member 46, such as a spherical valve member shown in FIGS. 1 and 2. The valve member 46 is held in its seated or closed position such as by a spring 48, both of the valve member 46 and spring 48 being located within the valve chamber 49. The upper wall of the valve chamber may be formed having a plug 47 formed therein, which allows insertion of the valve assembly including the spring when used, during assembly of the dispenser.

The valve chamber 49 is in communication with the exterior of the container by way of passages 50 and 52 which, in general, may be substantially horizontally and vertically oriented. The passage 52 is in communication with the dispensing tube 16.

In the embodiment of FIG. 1, the dispensing tube 16 extends downwardly from beneath the bottom wall 14. In the embodiment of FIG. 2, the dispensing tube 16 extends outwardly from the side wall 12; or alternatively, it may extend outwardly as shown in dotted lines at 17 as an extension of passage 50.

The passage 50 is formed, at 53, with a channel or shoulder at its junction with the valve chamber 49, so as to prevent any blockage of the passage 50 by the valve assembly or by collapse of the upper portion of the dispenser immediately above the passage 50.

The dispensing tube 16 is also perfectly closed until its first use, in the same manner as the exterior vent tube 32, and the tube 16 may be formed integrally with the dispenser or provided as a separate tube which is inserted and secured having communication with passage 52 (or passage 50).

The various passages and valve chambers can be provided in a number of ways. Thus, the passages may be provided by suitable moulding techniques using separable core members, or the dispenser body can be assembled from a plurality of components so as to provide the desired configuration. Preferable, the dispenser is formed of polyethylene or other similar material. The fluid tight securement of the dispenser and the container may be provided by frictional engagement, ultrasonic fusion, threading engagement or other similar securement means.

Briefly described, the operation of the dispenser, in association with a container having material therein, in accordance with the present invention is as follows: The ends of tubes 32 and 16 which are exterior of the container are first removed, and the dispenser is then ready for use. Squeezing or deforming of the container walls or any of them at a point above the bottom thereof, provides a slight positive pressure within the container with respect to the atmosphere. This pressure will force the material which is in the container to move towards and through the passages 42 and 43, past the valve member 46, through the valve chamber 49 and thence through the passages 50 and 52 to the exterior tube 16. Upon release of the pressure against the wall or walls of the container, a slight negative pressure (vacuum) with respect to the atmosphere will occur within the container, which permits the atmospheric pressure communicating through the vent tube 32 to open or unseat the valve member 28 within chamber 26 until such time as the pressure within the container has equalized to the atmospheric pressure without. At that time, the valve member 28 will again seat itself due to gravity.

In order to be particularly light weight for the purposes discussed, the valve member 28 (and the valve member 46) may be a nylon sphere or other similar material. It is obvious, of course, that the valve member 46 of the liquid dispensing valve assembly is self-closing, that is, on release of pressure against the walls of the container C, the spring 48 or other means biasing the valve will urge the valve member 46 to its closed position. Due to the location of the junction 40 between passages 42 and 43, at the bottom of the container C, a dispenser according to the present invention ensures that the container is substantially depleted of the material therein, and that no wastage or accidental spilling of the material can take place until the valve assembly is open for a dispensing operation as stated above.

Because, in general, the material being dispensed is a relatively highly viscous fluid with a high surface tension, and the material of the valve assembly is relatively non-wetting, the material being dispensed will withdraw slightly into the passage 52 (or 50) and thereby prevent a drying out or clogging effect of that passage and of the exterior dispensing tube 16.

Figure 5:
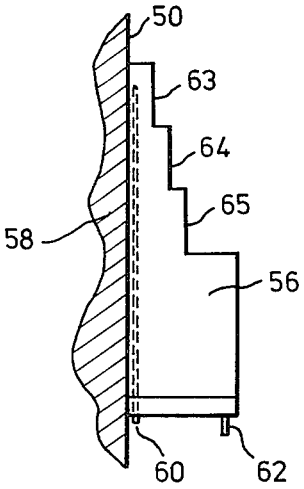
FIGS. 5 and 8 are simple line drawings showing adaptations of the present invention to various forms of liquid dispensing containers, having differing specific features.

Referring now to FIG. 5, a form of container having a dispenser according to the present invention associated therewith, is shown in such a manner that may be positiond against a wall 58. An external vent tube 60 may be positioned at the back wall of the container 56 and a dispensing tube 62 at the front wall thereof. The stepped portions 63, 64, and 65 of the container 56 permit greater, pre-calibrated, quantities of material to be dispensed upon exerting pressure against any of the respective stepped portions; and pressure exerted against the lower most portion of the container will result in any desired quantity of material being dispensed.

Figure 6:
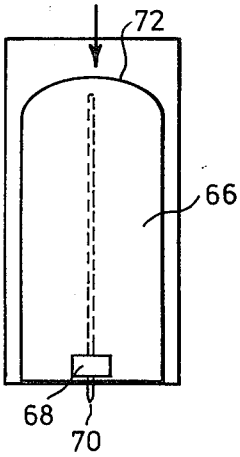

FIG. 6 shows a container which may be shaped so as to fit the recessed portion of a wall fixture normally found in bathrooms, where soap, a drinking glass, toothbrushes, etc., may otherwise be placed. The container 66 has a dispenser 68 in the bottom thereof, such that the dispensing spout 70 extends below the bottom; and liquid within the container 66 may be dispensed by pressing downwardly against the top 72 of the container 66.

Figure 7:
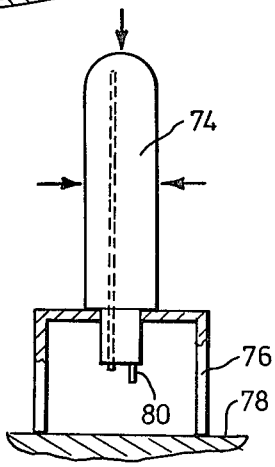

FIG. 7 shows a cylindrical configuration of container 74 which is fitted into a stand 76 mounted on a counter top 78, or otherwise. The fluid within the container 74 is dispensed from dispensing tube 80 by pressing downwardly against the top of the container 74 or by squeezing the walls thereof.

Figure 4:
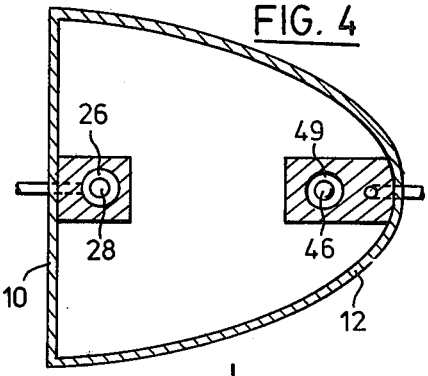
Figure 8:
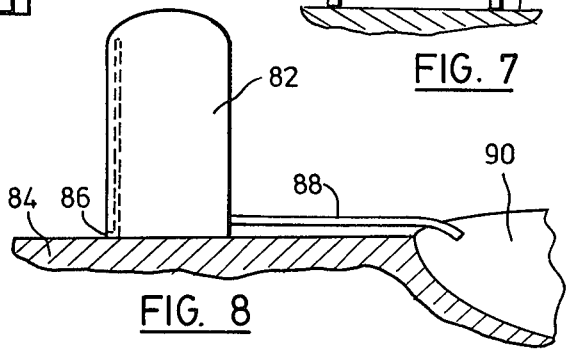

The container 82 shown in FIG. 8 may particularly be of the sort adapted to have a dispenser therein as illustrated in FIGS. 2 and 4. The container 82 in this case, is placed directly on a counter top 84, having an air inlet tube 86 and a liquid dispensing tube 88 extending substantially horizontally from the sides of the container 82. The dispensing tube 88 may be extended to any convenient length so as to allow discharge of the fluid within the container 82 into such as a wash basin 90. The dispensing action may be initiated by pressing against the top of the container 82 or squeezing the side walls thereof.

There are some circumstances which occur when it is particularly desireable to preclude an air/fluid contact of ambient air with the fluid contents of a dispenser. These may particularly be in medicinal and medical purposes, where it is desired that the fluid contents of the dispenser be antiseptic—i.e., that the introduction of air borne bacteria, spore or the like be precluded, and that the growth of such micro-organisms be prevented. Other, similar, circumstances may occur where it is desired to preclude aeration or air injestion which might, particularly in cases where the fluid within the dispenser is being administered intraveneously to a patient, occur in an embolism. Still other circumstances may occur where it is desireable to provide for portion dispensing or for very specific flow rates, and at the same time, preclude air/fluid contact.

In all othose circumstances discussed immediately above, it is possible to preclude the air/fluid contact at the interface of the air within the dispenser and the fluid therein, as discussed above with reference to the embodiments of FIGS. 1 through 8, by the provision of an inflateable or expandable liner, bag or bladder, which may either contain the air which vents into the dispenser at the same time as the fluid content is being dispensed therefrom, or which may in some circumstances enclose the fluid to be dispensed.

Figure 9:
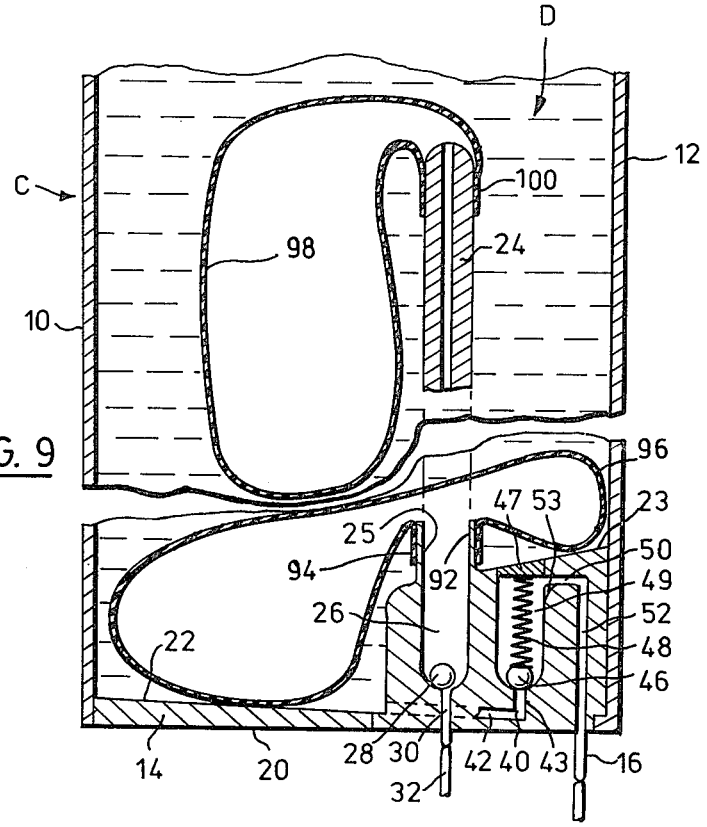
FIG. 9 illustrates additional alternative embodiments of the present invention, showing alternative positions for the inflateable bag or liner; and, FIG. 10 shows yet another alternative embodiment in which a gas impermeable liner is utilized.

As shown in FIG. 9, there are alternative ways by which the inflatable or collapsible bladder may be incorporated within a dispenser according to this invention. For example, the bore 25 from the valve compartment 26 may be extended upwardly by lips of neck 92, over which the mouth 94 of an inflatable bladder 96 may be securely fastened. The bladder 96 may be inflatable in the same manner as a balloon—i.e., by expansions and stretching of the skin of the bladder; or it may be inflatable or expandable by virtue of a multi-fold (accordian-like, or wrinkled) predisposition of the material of the bladder. In any event, in the same manner as discussed above, as the dispensing action is initiated by deformable or squeezing of the container walls, upon the release of pressure so that air may enter the container through the passage 30 past the valve member 28, the air enters the interior of the bladder 96 and the bladder expands, thereby equalizing pressure against the fluid within the container, with respect to the ambient.

Alternatively, as also indicated in FIG. 9, a bladder 98 might be installed within the container, with its mouth 100 fitting over the top end of a vent tube 24. Depending upon the relative amounts of fluid and air within the container and the bladder 98, the bladder may extend above the surface of the fluid, filling the top end of the container.

In all events, in the embodiments contemplated in FIG. 9, sufficient space will exist around the exterior of the bladder 96 or 98 to permit fluid within the container to fill the bottom portion thereof, due to gravity. The precise design and layout of the dispenser and the interior of the container may vary considerably, depending upon the viscosity and relative density of the fluid.

Figure 10:
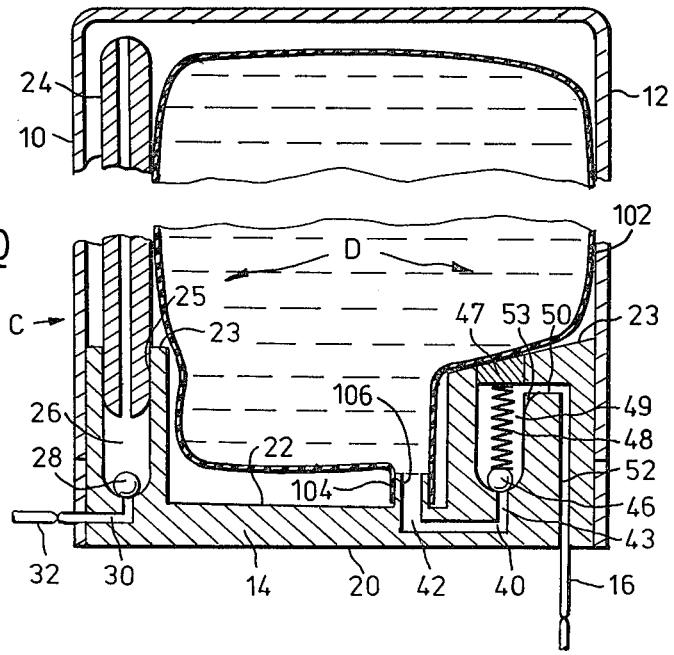

Turning to FIG. 10, there is shown yet a further embodiment of dispenser and container according to this invention, which achieves the same purposes as the alternative embodiments illustrated in FIG. 9, but in the opposite manner. Thus, air/fluid contact is, once again precluded, but in this case the fluid is maintained within the collapsible bladder 102 which is installed on the dispenser within the container, with its mouth 104 over neck 106 which is an extension of the passage 42. In the embodiment of FIG. 10, it will be seen that the dispensing operation is as before, except in this case the bladder 102 will collapse or contract as the fluid within it is dispensed, due to the pressure of air within the container against the exterior surface of the bladder.

In any of the embodiments of FIGS. 9 and 10, portion dispensing or controlled rate of dispensing may be achieved by design of the bladder so that the rate of expansion or contraction thereof or the amount by which it may expand or contract at any one moment, may be controlled. Additionally, the bladders 96, 98 or 102 may be connected through a suitable conduit to an air pump or other device—such as a foot operated pump or a valve on a pressure tank—to permit pressurization of the bladder and therefore dispensing of fluid within the container. By such arrangement, a controlled rate of fluid dispensing is possible; and, as stated above, air/fluid contact is precluded.

The embodiments described herein may be further modified in a number of ways. For example, the liquid dispensing valve assembly can specifically be a spring biased flap valve, or depending on its weight and the relative density of the fluid to be dispensed, it may be a gravity biased check valve. The air vent valve may also, of course, be a flap valve. Various modifications with respect to the air and liquid passages have been indicated, and would normally be considerations of the materials being used and the production requirements selected for any specific embodiment.

I claim:

1. A dispenser adapted to be located in the bottom of a container of which at least a portion of a wall thereof is flexible, said container being adapted for dispensing a fluid material contained therein upon deformation of said flexible portion thereof, said dispenser comprising:

a base member secured fluid tight in the bottom of said container;

first passage means in said base member having a first valve means in fluid communication therewith, for establishing an equal pressure within said container with respect to the atmosphere exteriorly thereof, and an interior air vent tube having a length slightly less than the interior height of the container, so as to reach above the maximum level of the fluid therein when said container is filled to its maximum allowable limit; and second passage means in said base member having a second valve means in fluid communication therewith, for dispensing said material from within said container through said second passage.

2. A dispenser in accordance with claim 1, where an exterior air vent extension tube extends from such dispenser and is sealed at its outer end until the first use of said dispenser.

3. A dispenser in accordance with claim 1, wherein said second passage means is in communication with an exterior dispensing tube which is sealed until first use of the dispenser.

4. A dispenser in accordance with claim 2 or 3, wherein said first and second valve means are seated and closed when the container is in the dispensing position with the dispenser at the bottom of the container and when the dispenser is not in a dispensing or pressure equalizing action, so that substantially no differential pressure exists between the interior of said container and the atmosphere.

5. A dispenser in accordance with claim 1 wherein the lowest point of said second passage is at the lower point within said container which is in communication with the interior thereof, so as to allow substantially complete dispensing of the material contained therein through said second passage.

6. A dispensing container for dispensing fluid material contained therein, and having a dispenser located in the bottom thereof;

at least a portion of a wall of said container being flexible; said dispenser comprising:

a base member secured fluid tight in the bottom of said container;

first passage means in said base member having a first valve means in fluid communication therewith, for establishing an equal pressure within said container with respect to the atmosphere exteriorly thereof, and an interior air vent tube having a length slightly less than the interior height of the container, so as to reach above the maximum level of the fluid therein when said container is filled to its maximum allowable limit; and second passage means in said base member having a second valve means in fluid communication therewith, for dispensing said material from within said container through said second passage.

7. A dispensing container in accordance with claim 6, wherein said first and second valve means are seated and closed when the container is in the dispensing position with the dispenser at the bottom of the container and when the dispenser is not in a dispensing or pressure equalizing action, so that substantially no differential pressure exists between the interior of said container and the atmosphere.

8. A dispensing container for dispensing fluid material contained therein, and having a dispenser located in the bottom thereof;

at least a portion of a wall of said container being flexible; said dispenser comprising:

a base member secured fluid tight in the bottom of said container;

first passage means in said base member having a first valve means in fluid communication therewith, for establishing an equal pressure within said container with respect to the atmosphere exteriorly thereof, and an interior air vent tube having a length slightly less than the interior height of the container, and further comprising an inflatable bladder in fluid communication with and secured to the end of said air vent tube remote from said first valve means; and second passage means in said base member having a second valve means in fluid communication therewith, for dispensing said material from within said container through said second passage.

9. A dispensing container for dispensing fluid material contained therein, and having a dispenser located in the bottom thereof;

at least a portion of a wall of said container being flexible; said dispenser comprising:

a base member secured fluid tight in the bottom of said container;

first passage means in said base member having a first valve means in fluid communication therewith, for establishing an equal pressure within said container with respect to the atmosphere exteriorly thereof, second passage means in said base member having a second valve means in fluid communication therewith, for dispensing said material from within said container through said second passage; and a collapsible fluid tight and air impermeable bladder having a mouth in fluid communication with said second passage means and said second valve means, said bladder being filled with the fluid to be dispensed; the exterior of said bladder being exposed to the interior of said container which is in fluid communication with said first passage means and said first valve means.

* * * * *